US006439242B1

(12) United States Patent
Head et al.

(10) Patent No.: US 6,439,242 B1
(45) Date of Patent: Aug. 27, 2002

(54) HAIR CLIP

(75) Inventors: Neal R. Head, Coppell; Michael Freitas, Southlake, both of TX (US)

(73) Assignee: NDHead, Inc., Coppell, TX (US)

( * ) Notice: Subject to any disclaimer, the term of this patent is extended or adjusted under 35 U.S.C. 154(b) by 0 days.

(21) Appl. No.: 09/520,573

(22) Filed: Mar. 8, 2000

(51) Int. Cl.[7] ..... A45D 8/04; A45D 8/00; A45D 8/20

(52) U.S. Cl. ..... 132/273; 132/276; 132/277

(58) Field of Search ..... 132/273, 275, 132/276, 277, 278, 279

(56) References Cited

U.S. PATENT DOCUMENTS

| | | | | | |
|---|---|---|---|---|---|
| 649,848 | A | * | 5/1900 | Koenig | 132/273 |
| 717,499 | A | | 12/1902 | Gouy | |
| 732,566 | A | | 6/1903 | Koenig | |
| 859,797 | A | | 7/1907 | Bechtold | |
| 1,234,308 | A | * | 7/1917 | Droll | 132/275 |
| D167,553 | S | | 8/1952 | Behr | |
| 2,637,328 | A | | 5/1953 | Behr | |
| 2,813,533 | A | | 11/1957 | Fay | |
| 3,842,849 | A | | 10/1974 | Goodman | |
| 4,785,834 | A | | 11/1988 | Gonzalez | |
| 4,919,155 | A | | 4/1990 | Yasuda | |
| 4,976,277 | A | | 12/1990 | Yasuda | |
| 5,355,899 | A | | 10/1994 | Kuo-Hua | |
| 5,520,201 | A | | 5/1996 | Hart et al. | |
| 5,535,765 | A | | 7/1996 | Takashima | |
| 5,699,815 | A | | 12/1997 | Furukawa | |
| 5,749,382 | A | | 5/1998 | Tsai | |
| 5,785,065 | A | | 7/1998 | Johnson | |
| 5,822,798 | A | | 10/1998 | Baxley | |
| 5,873,376 | A | | 2/1999 | Howley | |
| 5,890,494 | A | * | 4/1999 | Sonstegard | 132/273 |
| 5,890,497 | A | * | 4/1999 | Tsai | 132/273 |
| 5,893,377 | A | | 4/1999 | Chen | |
| 5,901,713 | A | | 5/1999 | Mroczek | |

FOREIGN PATENT DOCUMENTS

| | | | | |
|---|---|---|---|---|
| DE | 370792 | * | 3/1923 | 132/279 |
| GB | 2219741 | * | 12/1989 | 132/273 |

* cited by examiner

*Primary Examiner*—John J. Wilson
*Assistant Examiner*—Robyn Kieu Doan
(74) *Attorney, Agent, or Firm*—Gardere Wynne Sewell LLP

(57) ABSTRACT

A hair clip includes a pair of semi-annular band portions and a living hinge that extends between, and is integrally formed with proximal ends of the band portions to thereby join the band portions together for pivotal movement between open and closed positions. A locking depression is formed at the distal end of one band portion and a locking projection formed at the distal end of the other band portion. The locking projection and depression are mutually engageable in a snap-fit arrangement to thereby secure the band portions together in the closed position.

3 Claims, 3 Drawing Sheets

HAIR CLIP

BACKGROUND OF THE INVENTION

1. Field of the Invention

This invention relates generally to accessories for binding hair, and more particularly to a hair clip of single-piece construction that may be used during participation in athletic events.

2. Description of the Related Art

During athletic events, participants with long hair customarily tie or bind their hair back behind the face to prevent loose hair from causing distraction and possible injury. Regulations of the University Interscholastic League (UIL) restrict the type of accessories that may be worn by students participating in athletic events. Among these accessories, hair clips having protruding features or sharp edges may not be used since injury may result to the person wearing the hair clip or to other participants. It has been conventional practice to use an elastic band or the like that is twisted and formed into multiple rings to bind a bunch of long hair together. The long hair is passed through the rings of elastic band to be bound near its root end. However, this practice is both time consuming and troublesome since the hair may easily become ruffled during binding and end up in a non-uniform finish. Moreover, the elastic band itself may damage the hair, especially when it is wrapped too tightly around the hair.

SUMMARY OF THE INVENTION

It is therefore an object of the present invention to provide a hair clip that is relatively easy to use.

It is a further object of the invention to provide a single piece hair clip that binds the hair in a secure manner without damaging the hair.

It is an even further object of the invention to provide a hair clip that is relatively low in cost and easy to manufacture.

According to the invention, a hair clip includes a pair of semi-annular band portions and a living hinge that extends between, and is integrally formed with proximal ends of the band portions to thereby join the band portions together for pivotal movement between open and closed positions. A locking depression is formed at the distal end of one band portion and a locking projection is formed at the distal end of the other band portion. The locking projection and depression are mutually engageable to thereby secure the band portions together in the closed position. The band portions are adapted to receive a bunch of hair in the open position, and are adapted to compress and hold the bunch of hair in the closed position.

Further according to the invention, a hair clip includes a pair of semi-annular band portions joined at their proximal ends by a hinge for pivotal movement between open and closed positions. The hinge may be a living hinge, a film hinge, a spring hinge, a piano hinge, or any other means for pivotally connecting the band portions together. A locking depression is formed at the distal end of one band portion and a tab extends generally circumferentially from the distal end of the other band portion. A locking projection is formed integral with the tab for locking engagement with the locking depression of the one band portion to thereby secure the band portions together in the closed position.

Other objects and advantages of the invention will become apparent upon reading the following detailed description and appended claims, and upon reference to the accompanying drawings.

BRIEF DESCRIPTION OF THE DRAWINGS

The preferred embodiments of the present invention will hereinafter be described in conjunction with the appended drawings, wherein like designations throughout the drawings denote like elements, and wherein.

It is noted that the drawings are not necessarily to scale. The drawings are intended to depict only typical embodiments of the invention, and therefore should not be considered as limiting the scope thereof. The invention will now be described in greater detail with reference to the accompanying drawings.

DETAILED DESCRIPTION OF THE PREFERRED EMBODIMENTS

Figure 1:
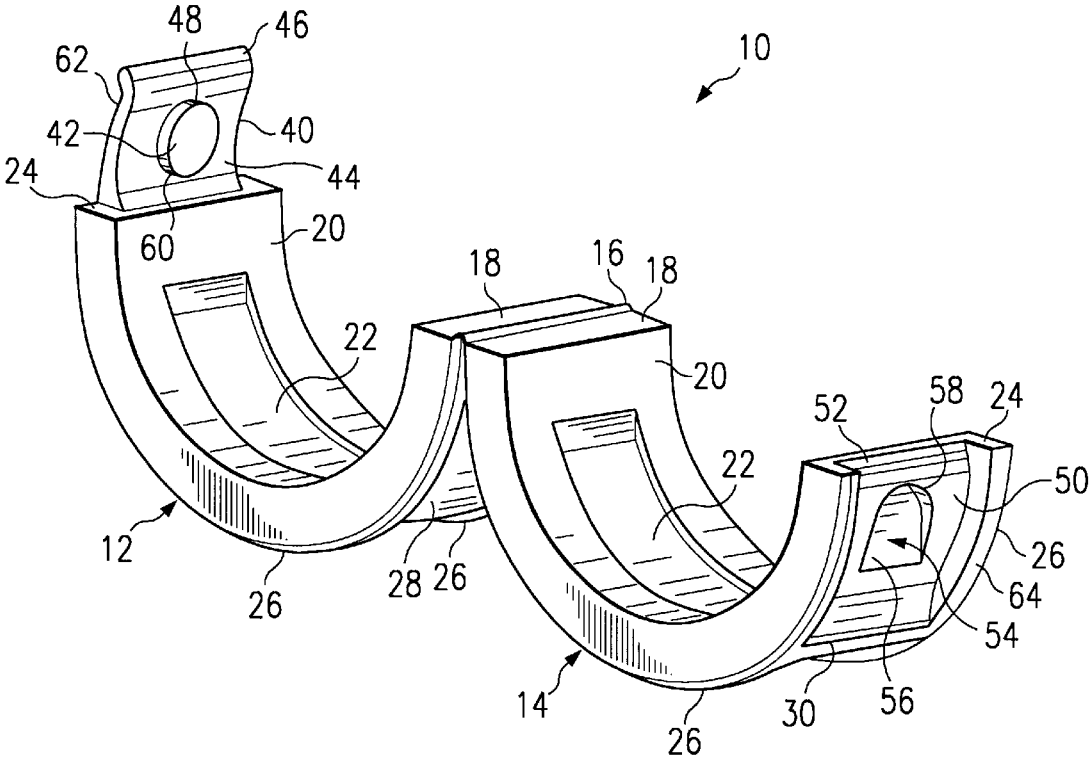
FIG. 1 is an isometric view of a hair clip according to the present invention in an open position.

Referring now to the drawings, and to FIG. 1 in particular, a hair clip 10 includes a first semi-annular band portion 12 connected to a second semi-annular band portion 14 through a living hinge 16. The band portions 12, 14 and living hinge 16 are preferably constructed of a plastic material, such as polypropylene, and are integrally formed together during the molding process. It is to be understood, of course, that other materials may be used for the hair clip 10. Preferably, the hinge 16 extends between, and is integrally formed with proximal ends 18 of the band portions 12, 14 to thereby join the band portions together. The living hinge 16 is constructed of the same material as the band portions but only thinner in cross section as shown most clearly in FIG. 5, to thereby form a flexible connection between the band portions. In this manner, the band portions can pivot between an open position (FIG. 1) and a closed position (FIG. 6).

With additional reference to FIGS. 2 through 5, each semi-annular band portion 12, 14 includes an arcuate inner surface 20 with an arcuate depression 22 formed in the inner surface. Each depression 22 extends between the proximal end 18 and a distal end 24 of its respective band portion. Preferably, each depression is uniform in depth and follows the arcuate contour of the inner surface 20.

Figure 3:
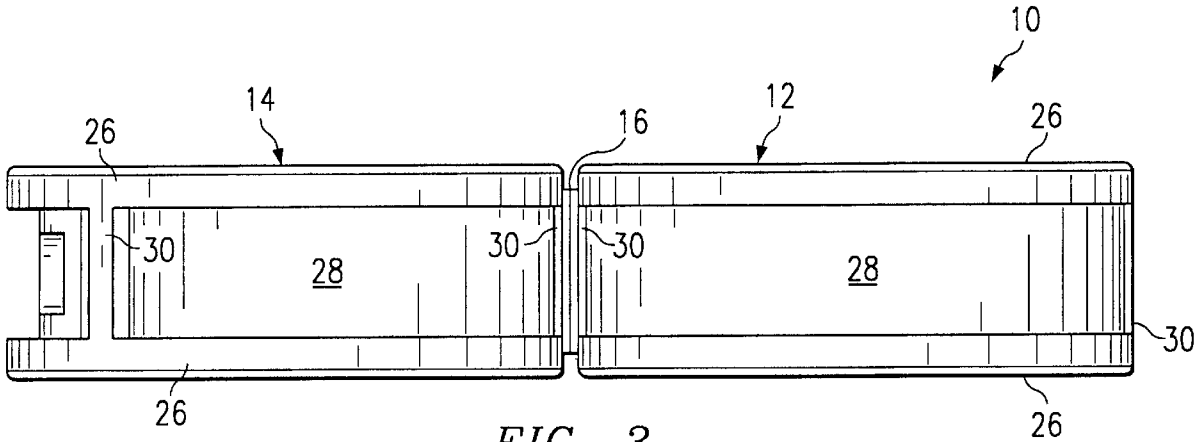
FIG. 3 is a bottom plan view of the hair clip in the open position.
Figure 4:
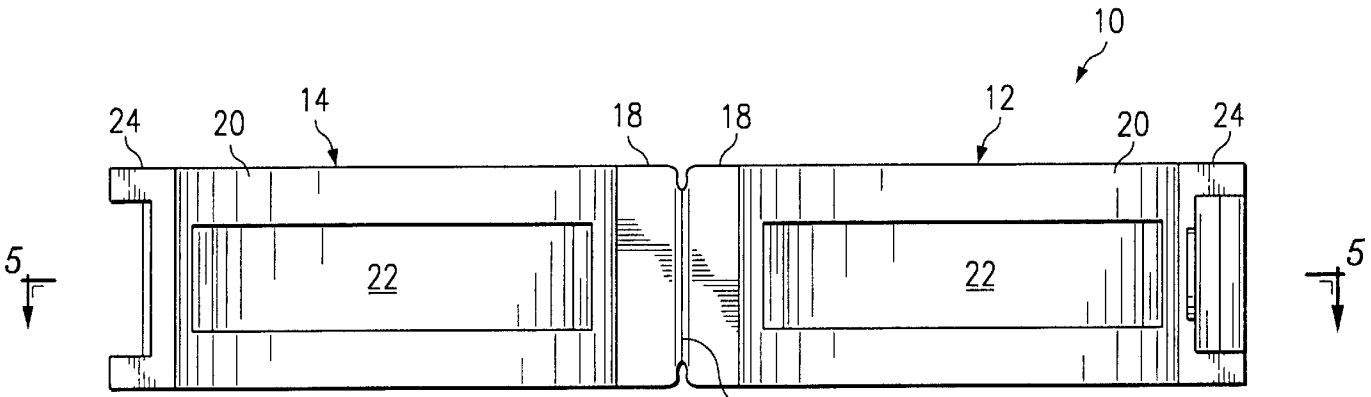
FIG. 4 is a top plan view of the hair clip in the open position.

As shown most clearly in FIGS. 1 and 3, a pair of arcuate ridges 26 are formed on an outer surface 28 at a peripheral edge of each band portion 12, 14. The ridges 26 help to provide strength and rigidity to each band portion while reducing material weight. Cross ridges 30 are also formed on the outer surface 28 close to the proximal and distal ends 18 and 24, respectively, of each band portion. Preferably, the cross ridges 30 extend between and are integral with the arcuate ridges 26. In an alternative arrangement, the arcuate ridges 26 and/or cross ridges 30 may be eliminated to provide a smooth outer surface 28.

Figure 2:
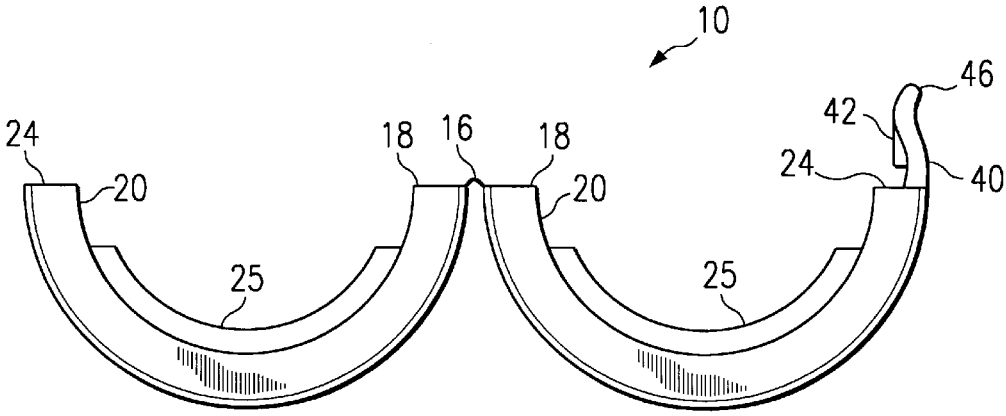
FIG. 2 is a side elevational view of the hair clip in the open position.
Figure 6:
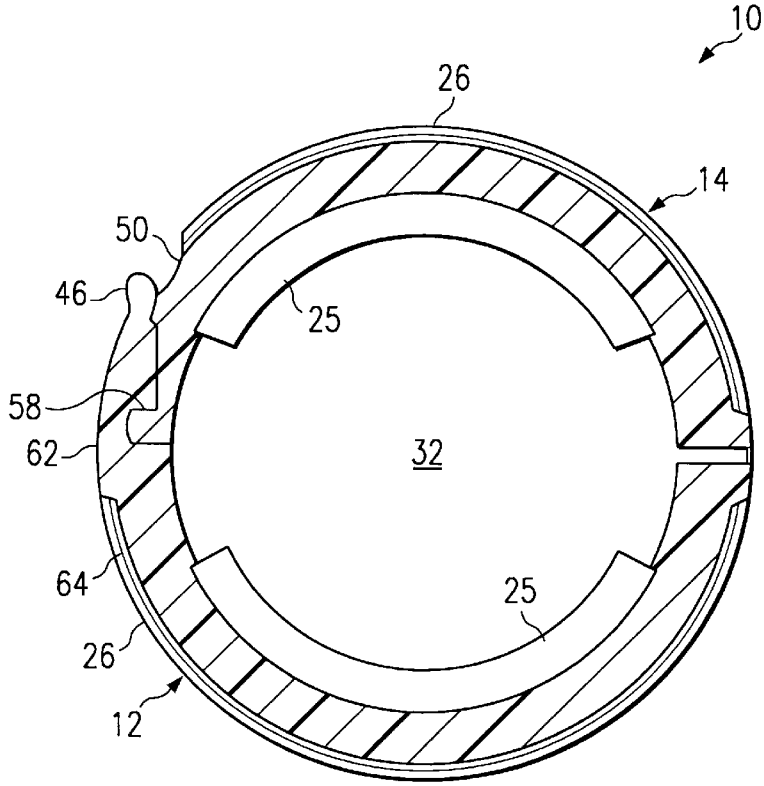
FIG. 6 is a cross sectional view of the hair clip in a closed position.

As shown most clearly in FIGS. 2 and 6, a resilient member 25 is mounted in the depression 22 of each band portion through adhesive bonding or other well known attaching means. Preferably, each resilient member 25 is constructed of an open cell polyurethane or elastomeric foam material that exhibits a relatively high coefficient friction. Each resilient member 25 is preferably of uniform thickness throughout its length. Alternatively, the resilient members 25 may vary in thickness and shape. The resilient members 25 are adapted to frictionally engage and resiliently press against a bunch of hair that is received in an opening 32 formed by closure of the band portions 12, 14 (FIG. 6). In an alternative arrangement, the resilient members 25 can be replaced with bristles, spikes or combs, or any other means for securing the hair clip 10 to the bunch of hair. When bristles or spikes are used in place of one or more resilient members 25, they should be kept within the confines of the band portions 12, 14 in order to avoid possible injury from the spikes or bristles during sporting activities.

Figure 5:
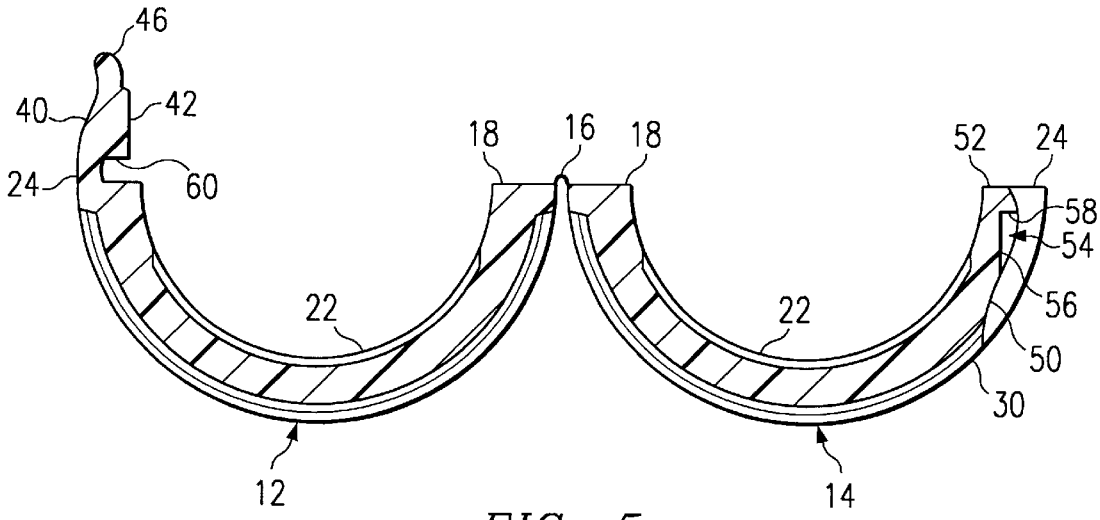
FIG. 5 is a cross sectional view of the hair clip in the open position taken along line 5—5 of FIG. 4.

As shown best in FIGS. 1 and 5, a tab 40 is formed at the distal end 24 of the semi-annular band portion 12. Preferably, an outer surface 62 of the tab 40 extends generally circumferentially from the distal end about an arcuate center that is coincident with the arcuate center of an outer surface 64 of the arcuate ridges 26. Alternatively, the arcuate center of the outer surface 62 may be coincident with the outer surface 28 of the band portion 12. A locking projection 42 is formed on an inner surface 44 of the tab 40. The locking projection 42 is formed as a generally cylindrical boss that tapers toward a lip section 46 formed at an outer free end of the tab 40. Preferably, an upper edge 48 of the boss 42 is substantially planar with the inner surface 44 adjacent the lip section 46. As shown, the lip section 46 is curved generally outwardly and is coincident with a ramp section 50 when the band portions 12, 14 are in the closed position (FIG. 6). In this manner, the lip section 46 serves as a catch that may be grasped by a user in order to open the hair clip 10.

The ramp section 50 is formed on the distal end 24 of the semi-annular band portion 14. The ramp section 50 preferably extends between the arcuate ridges 26 and tapers from the cross ridge 30 to a chamfered end 52. A pocket 54 is formed in the ramp section 50 and is shaped to receive the locking projection 42. The pocket 54 includes a surface 56 that extends generally inwardly from the ramp section 50 proximal the cross ridge 30 to a curved wall 58 proximal the chamfered end 52. The curved wall 58 is similar in shape to a lower edge 60 of the locking projection 42. In this manner, the locking projection 42 is received within the pocket 54 in a locking manner when the band portions 12, 14 are in the closed position, as shown in FIG. 6. The living hinge 16 is preferably formed to be in tension when the band portions are in the closed position to thereby create a biasing force that tends to push the band portions toward the open position to thereby bias the locking projection into secure engagement with the pocket.

In use, the hair clip 10 is opened and positioned around the user's hair and then closed such that the proximal end 18 and distal end 24 of one band portion are in opposed, facing relationship with the proximal end 18 and distal end 24 of the other band portion. During closure, the curved surface of the lip section 46 initially engages the chamfered end 52 of the ramp section 50 which causes the tab 40 to deflect slightly outwardly. With the upper surface 48 of the locking projection 42 being generally planar with the inner surface 44 of the tab 40, the locking projection 42 can be easily slid over the chamfered end section 52 until the bottom surface 60 clears the curved wall 58 of the pocket 54. The locking projection 42 will then drop into the pocket 54 as the tab 40 returns to its initial undeflected position to thereby provide a snap-fit locking engagement. This can be done with one hand to thereby leave the other hand free for gathering and holding the hair together. The width of the tab 42 can be formed slightly less than the arcuate ridges 26 to be received therein in a flush manner. Also, the thickness of the tab 40 is preferably substantially equal to the depth of the ramp 50 so that the outer surface 62 of the tab 40 is flush with the outer surfaces 64 of the arcuate ridges 26. In this manner, the outer periphery of the hair clip 10 in a closed position is free of protruding members that may otherwise cause injury during sporting activities. When in the closed position, the bunch of hair can be located in the opening 32 (FIG. 6) formed by the arcuate surfaces 20 and securely held in place by the resilient members 25.

When it is desirous to open the hair clip 10 for clamping a bunch of hair or for releasing the hair clip from the hair, a user need only hook a fingertip under the lip section 46 and press the tab 40 outwardly until the projection 42 clears the pocket 54.

It is to be understood that the terms inwardly, outwardly, upper, lower, and their respective derivatives as may be used throughout the specification denote relative, rather than absolute positions or orientations.

While the invention has been taught with specific reference to the above-described embodiments, those skilled in the art will recognize that changes can be made in form and detail without departing from the spirit and the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The embodiments for which an exclusive property or privilege is claimed are defined as follows:

1. A hair clip comprising:

a pair of semi-annular band portions each band portion having a proximal end and a distal end;

an integral living hinge connecting the proximal ends of said pair of semi-annular band portions for pivotal movement between open and closed positions;

a ramp section at the distal end of one semi-annular band portion;

a locking depression formed in the ramp section;

a tab formed at the distal end of the other semi-annular band portion, the tab extending generally circumferentially from the distal end of the other semi-annular band portion;

a lip section formed at an outer free end of the tab;

a locking projection formed on an inner surface of the tab and engageable with the locking depression of the one semi-annular band portion to thereby secure the semi-annular band portions together in the closed position; and the semi-annular band portions in the open position being adapted to receive a bunch of hair, and in the closed position together forming an opening that compresses the bunch of hair to thereby secure the hair clip to the bunch of hair.

2. A hair clip according to claim 1, wherein each semi-annular band portion has an inner surface that forms said opening when the semi-annular band portions are in the closed position; and further comprising at least one resilient member connected to the inner surface of at least one of the semi-annular band portions to thereby resiliently compress the bunch of hair in the opening.

3. A hair clip according to claim 2, said at least one resilient member comprises a pair of resilient members, each resilient member being connected to the inner surface of a respective semi-annular band portion in opposed relationship.

* * * * *